US011666795B2

(12) United States Patent
Chen

(10) Patent No.: US 11,666,795 B2
(45) Date of Patent: Jun. 6, 2023

(54) ADJUSTABLE DUMBBELL

(71) Applicant: Floriey Industries International Co., Taichung (TW)

(72) Inventor: Paul Chen, Taichung (TW)

(73) Assignee: FLORIEY INDUSTRIES INTERNATIONAL CO., Taichung (TW)

( * ) Notice: Subject to any disclaimer, the term of this patent is extended or adjusted under 35 U.S.C. 154(b) by 123 days.

(21) Appl. No.: 17/385,417

(22) Filed: Jul. 26, 2021

(65) Prior Publication Data

US 2023/0027679 A1 Jan. 26, 2023

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/072–075; A63B 21/0605; A63B 21/00058–00065
See application file for complete search history.

(56) References Cited

U.S. PATENT DOCUMENTS 4,566,690 A 1/1986 Schook
5,407,413 A 4/1995 Kupferman
5,839,997 A 11/1998 Roth et al.
6,656,093 B2 12/2003 Chen
7,011,611 B1 * 3/2006 Ripley ..... A63B 21/0728 482/107
7,223,214 B2 5/2007 Chen
7,731,641 B1 6/2010 Chen
7,811,213 B2 10/2010 Chen
7,887,469 B1 2/2011 Chen
8,992,396 B2 * 3/2015 Wang ..... A63B 21/0726 482/106
11,179,594 B2 * 11/2021 Chen ..... A63B 21/0728
2007/0167300 A1 * 7/2007 Krull ..... A63B 21/075 482/107

* cited by examiner

*Primary Examiner* — Loan B Jimenez
*Assistant Examiner* — Kathleen M Fisk
(74) *Attorney, Agent, or Firm* — Browdy and Neimark, PLLC

(57) ABSTRACT

An adjustable dumbbell device includes one or more weight members and one or more weight elements each having two side panels to form a chamber, and an opening formed in each of the panels, two housings detachably engaged in the weight member and the weight element, two catches slidably engaged in each of the housings and engageable with the openings of the panels for anchoring the housings to the weight member and the weight element selectively, two followers are rotatably engaged in each of the housings and each include a gear engaged with the catches for moving the catches to engage with the panels and to anchor the housings to the weight member and the weight element respectively.

12 Claims, 8 Drawing Sheets

ADJUSTABLE DUMBBELL

BACKGROUND OF THE INVENTION

1. Field of the Invention

The present invention relates to an adjustable dumbbell, and more particularly to an adjustable dumbbell assembly having an easily and quickly adjustable structure for allowing the adjustable dumbbell to be easily and quickly adjusted to different weights and to be easily and quickly actuated or operated or controlled by the user.

2. Description of the Prior Art

Various kinds of typical adjustable dumbbells have been developed and provided for conducting various weight lift exercise operations, for example, U.S. Pat. No. 4,566,690 to Schook, U.S. Pat. No. 5,407,413 to Kupferman, U.S. Pat. No. 5,839,997 to Roth et al., U.S. Pat. No. 6,656,093 B2 to Chen, U.S. Pat. No. 7,223,214 B2 to Chen, U.S. Pat. No. 7,731,641 B1 to Chen, U.S. Pat. No. 7,811,213 to Chen, and U.S. Pat. No. 7,887,469 to Chen disclose several of the typical adjustable dumbbells each including a number of weight rings that may be selectively or adjustably secured together with a handle bar for adjusting the weight of the dumbbells and for allowing the weight rings of different weight to be selectively coupled together and to be actuated or operated by the user.

Normally, in the typical adjustable dumbbells, two extension carriers or tracks are formed or provided on the end portions or extended outwardly from the end portions of the central handle bar, and the weight rings may be selectively or adjustably secured to the extension carriers or tracks.

However, the extension carriers or tracks are required to be permanently formed or provided on the end portions of the central handle bar such that the extension carriers or tracks and the central handle bar may form and may include a greatly increased length for the typical adjustable dumbbells and such that the length of the typical adjustable dumbbells may not be suitably reduced or decreased.

In addition, a slidable adjusting latch device is normally and typically engaged in the handle bar and movable relative to the handle bar in order to engage with the weight rings of different weight, such that the handle bar have to be excavated to form a longitudinal channel therein for slidably receiving or engaging with the adjusting latch device, and such that the strength of the handle bar will be decreased greatly.

The present invention has arisen to mitigate and/or obviate the afore-described disadvantages of the conventional adjustable dumbbells.

SUMMARY OF THE INVENTION

The primary objective of the present invention is to provide an adjustable dumbbell assembly including an adjustable structure that may be easily and quickly adjusted to different weights and that may be easily and quickly actuated or operated or controlled by the user.

The other objective of the present invention is to provide an adjustable dumbbell assembly including a structure having no extension carriers or tracks formed or provided on the end portions or extended outwardly from the end portions of the central handle bar such that the total length of the dumbbell assembly may be selectively decreased.

In accordance with one aspect of the invention, there is provided an adjustable dumbbell assembly comprising a first weight member including two side panels to form a chamber in the first weight member, and including an opening formed in each of the panels, a first housing detachably engaged in the chamber of the first weight member, two first catches slidably received and engaged in the first housing and slidably engageable with the openings of the panels for anchoring the first housing to the first weight member selectively, a first follower rotatably received and engaged in the first housing, and the first follower including a first gear engaged with the first catches for moving the first catches to engage with the openings of the panels and to anchor the first housing to the first weight member selectively, a first weight element including two side panels to form a chamber in the first weight element, and including an opening formed in each of the panels of the first weight element, a second housing detachably engaged in the chamber of the first weight element, two second catches slidably received and engaged in the second housing and slidably engageable with the openings of the panels of first weight element for anchoring the second housing to the first weight element selectively, a second follower rotatably received and engaged in the second housing, and the second follower including a second gear engaged with the second catches for moving the second catches to engage with the openings of the panels of first weight element and to anchor the second housing to the first weight element selectively, and a handle bar engaged into the first and the second housings, and the handle bar being secured to the first and the second followers for rotating the first and the second followers relative to the first and the second housings and for actuating the first and the second catches to engage with the openings of the panels of first weight member and of first weight element and for anchoring the first and the second housings to the first weight member and the first weight element respectively.

The first and the second housings each include a projection for engaging with the first and the second followers and for anchoring the first and the second followers to the first and the second housings respectively. The first and the second followers each include at least one recess for engaging with the projection.

At least one second weight member may further be provided and includes a chamber formed in the second weight member for receiving the first weight member. The second weight member includes two side panels, and an opening formed in each of the panels of the second weight member for selectively engaging with the first catches.

At least one second weight element may further be provided and includes a chamber formed in the second weight element for receiving the first weight element. The second weight element includes two side panels, and an opening formed in each of the panels of the second weight element for selectively engaging with the second catches.

The first and the second housings each include a frame for selectively engaging with the first and the second followers and for anchoring the first and the second followers to the first and the second housings respectively. The frames each include a key for selectively engaging with the first and the second followers respectively.

The first and the second followers each include at least one tooth for selectively engaging with the key of the frame respectively. The first and the second housings each include a spring biasing member engaged with the frame for biasing and forcing the key to engage with the first and the second followers respectively.

A receptacle may further be provided and includes two compartments formed in the receptacle, and two studs extended into the compartments of the receptacle respectively and engageable with the frames for forcing the keys of the frames to be disengaged from the first and the second followers.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
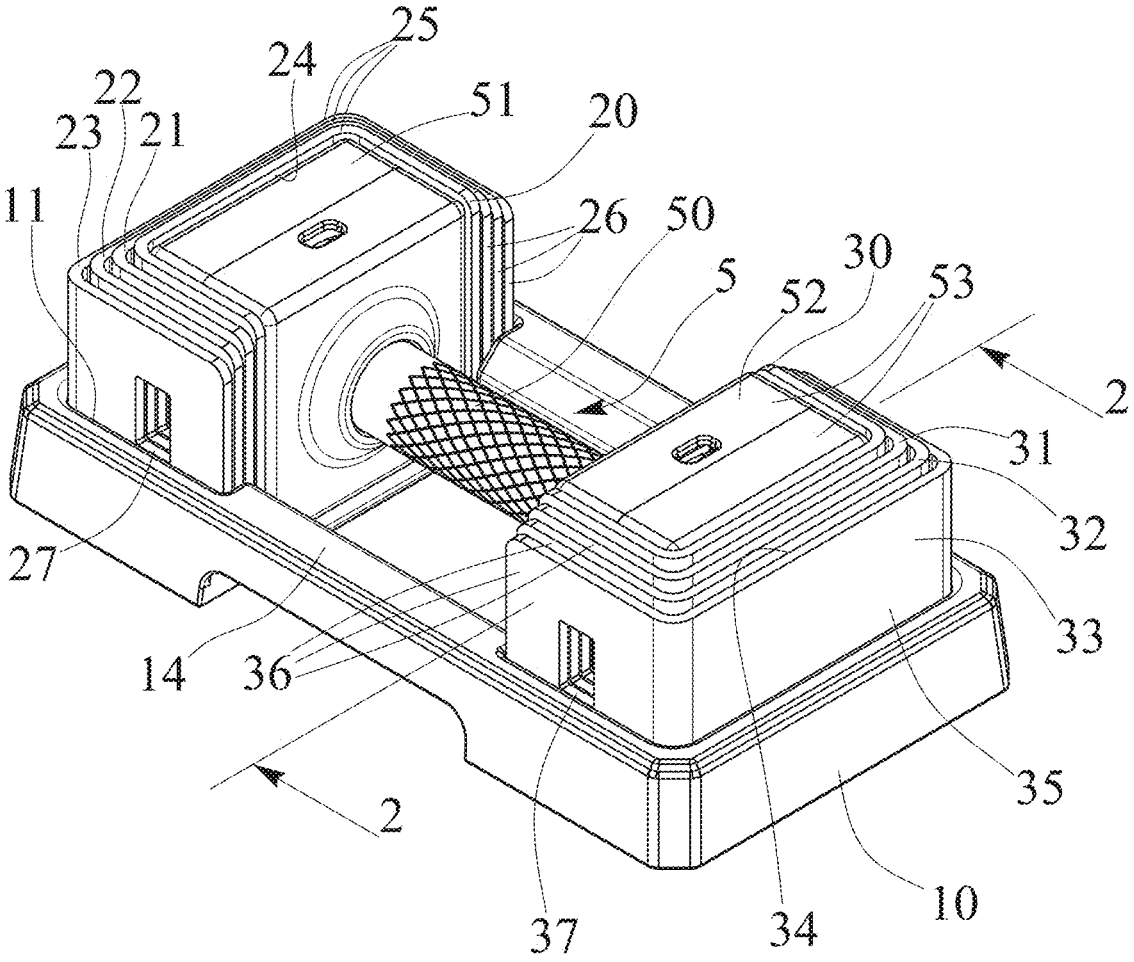
FIG. 1 is an upper perspective view of an adjustable dumbbell assembly in accordance with the present invention.

Referring to the drawings, and initially to FIGS. 1-6, an adjustable dumbbell assembly in accordance with the present invention comprises a supporting base or receptacle 10 including one or more (such as two) depressions or recesses or compartments 11 formed therein for selectively receiving or engaging with the weights, such as weight rings or plates or members 20-23 and weight elements 30-33 respectively, and including one or more (such as two) projections or studs 12, 13 formed or provided therein, such as extended upwardly into the compartments 11 of the receptacle 10 respectively. The weight members 20-23 and the weight elements 30-33 each include a compartment or chamber 24, 34 formed therein for forming or defining a base plate 25, 35 and two side panels 26, 36, and each include an opening 27, 37 formed in each of the panels 26, 36, and the opening 27, 37 in the panels 26, 36 are aligned with each other.

The weight members 20-23 and the weight elements 30-33 include a size or dimension or standard different from each other for allowing the weight members 20-23 and the weight elements 30-33 to be superposed or overlapped or engaged with each other, for example, the inner or first or primary weight member 20 and weight element 30 each include a size or dimension or standard smaller than that of the chamber 24, 34 of the intermediate or second or auxiliary and the other weight members 21-23 and weight element 31-33 for allowing the weight members 20-23 and the weight elements 30-33 to be superposed or overlapped or engaged with each other and to be received or engaged in the compartments 11 of the receptacle 10 respectively. The chambers 24, 34 of the weight members 20-23 and the weight elements 30-33 are faced or opened or directed toward the middle or intermediate or central portion 14 of the receptacle 10.

Figure 5:
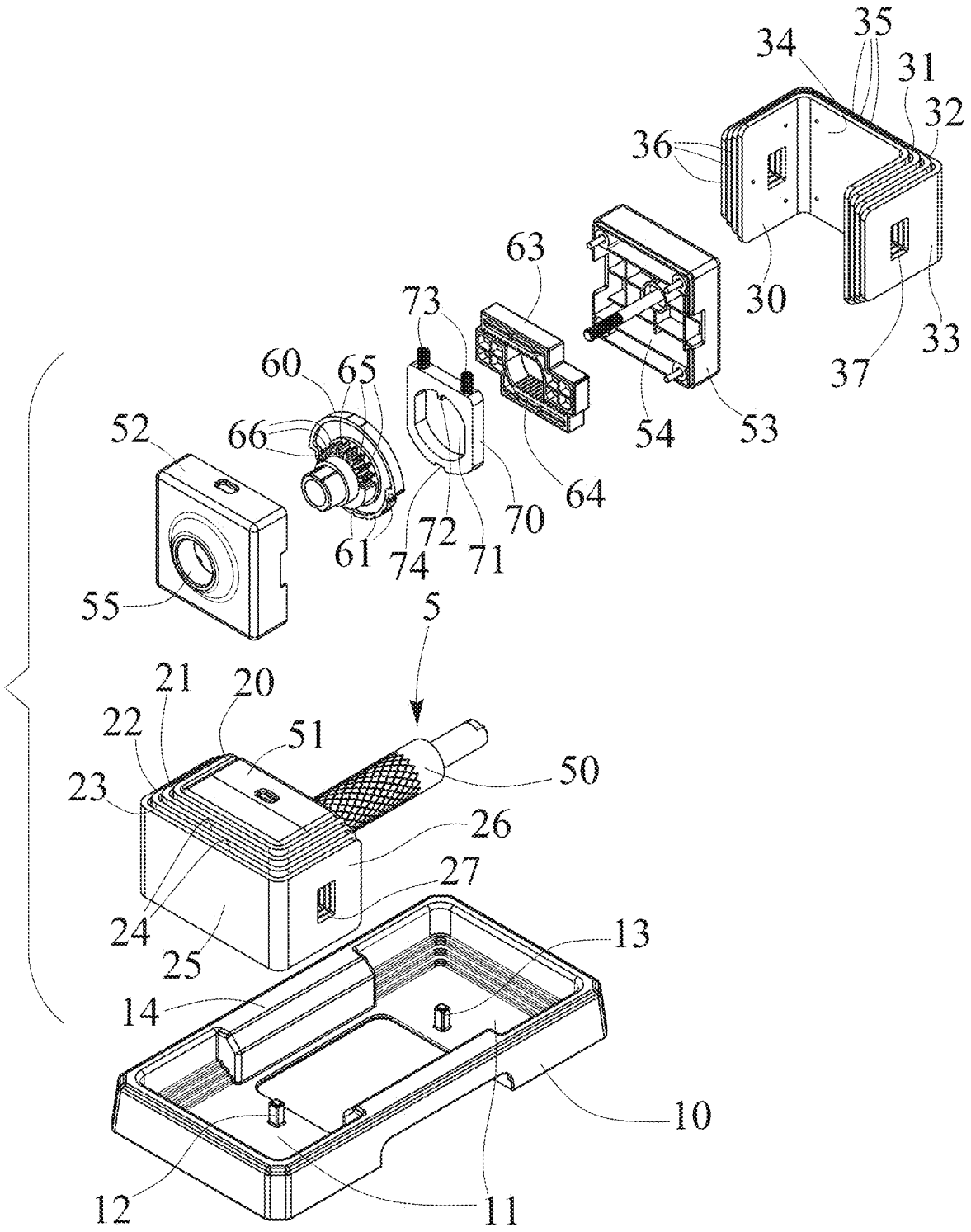
FIG. 5 is another partial exploded view of the adjustable dumbbell assembly.
Figure 6:
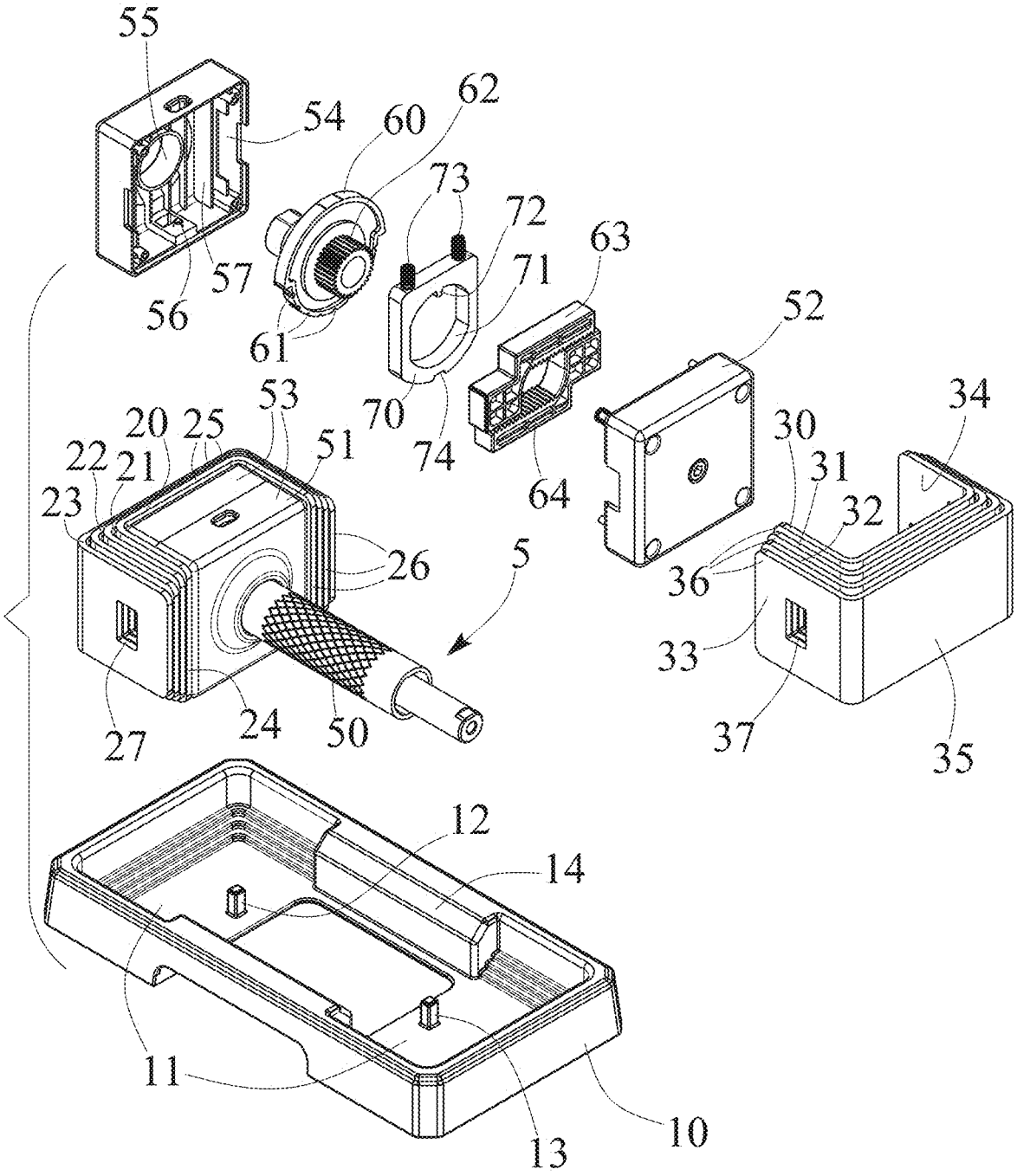
FIG. 6 is a further partial exploded view of the adjustable dumbbell assembly, as seen from another direction opposite to that shown in FIG. 5.

The dumbbell assembly further includes a central handle mechanism 5 having a handle bar 50, and one or more (such as two) casings or housings 51, 52, or first and second housings 51, 52 attached or mounted or secured or coupled to the end portions of the handle bar 50 respectively. As best shown in FIGS. 5 and 6, the housings 51, 52 each include one or more (such as two) housing members 53 secured or coupled together, and each include a chamber or a space 54 formed therein, and each include an opening or orifice 55 formed therein and communicating with the space 54 thereof and faced or opened or directed toward the middle or intermediate or central portion 14 of the receptacle 10 for receiving or engaging with the handle bar 50, and for allowing the housings 51, 52 to be attached or mounted or coupled to the handle bar 50 respectively. The handle bar 50 is pivotable or rotatable relative to the housings 51, 52. The housings 51, 52 include a size or dimension or standard smaller than that of the chamber 24, 34 of the inner or first or primary weight member 20 and weight element 30 for allowing the housings 51, 52 to be detachably received or engaged into the chambers 24, 34 of the first or primary weight member 20 and weight element 30 respectively.

Figure 9:
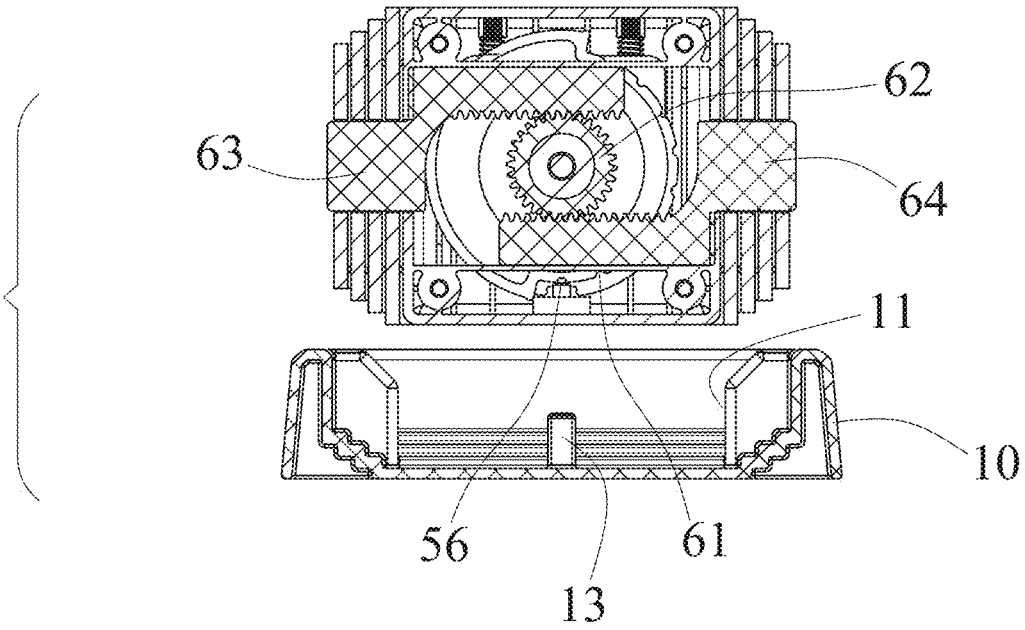
FIGS. 9, 10 are cross sectional and partial exploded views of the adjustable dumbbell assembly as shown in FIGS. 7 and 8 respectively.
Figure 10:
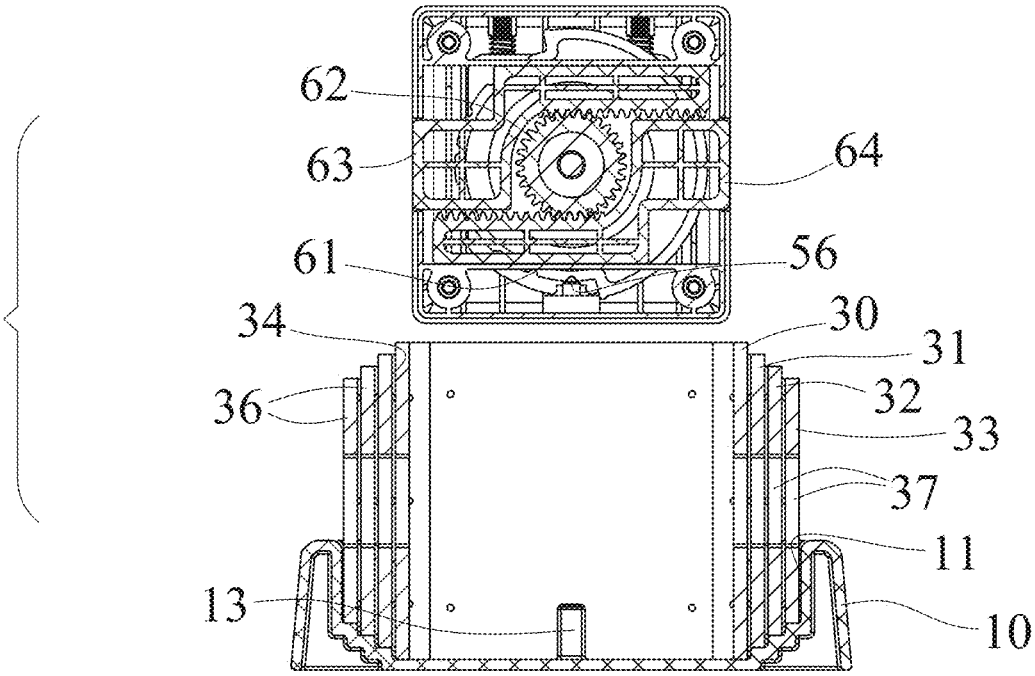

The housings 51, 52 each include a rotary member or follower 60 received or engaged therein, and attached or mounted or keyed to the handle bar 50 for allowing the followers 60 to be pivoted or rotated in concert with the handle bar 50, or for allowing the followers 60 to be pivoted or rotated relative to the housings 51, 52 with or by the handle bar 50. The followers 60 each include one or more depressions or recesses 61 formed therein, such as formed in the lower or bottom portion thereof, and the housings 51, 52 each include a spring biased detent or projection 56 (FIG. 6) formed or provided therein for engaging with either of the recesses 61 of the follower 60 (FIGS. 9, 10) and for anchoring or retaining or positioning the follower 60 to the housing 51, 52 at the selected or predetermined or required angular position or location. The followers 60 each include a pinion or gear 62 (FIG. 6) formed or provided thereon.

Figure 2:
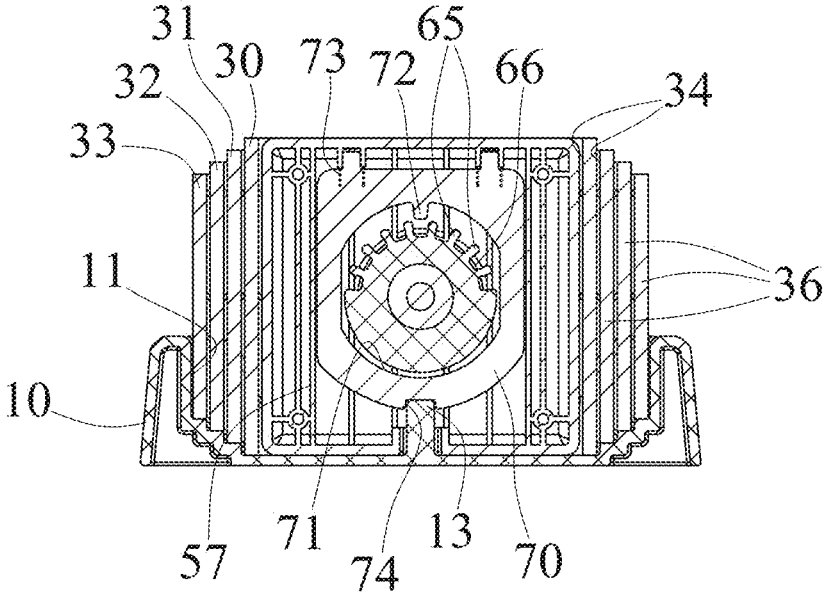
FIG. 2 is a cross sectional view of the adjustable dumbbell assembly, taken along lines 2-2 of FIG. 1.
Figure 3:
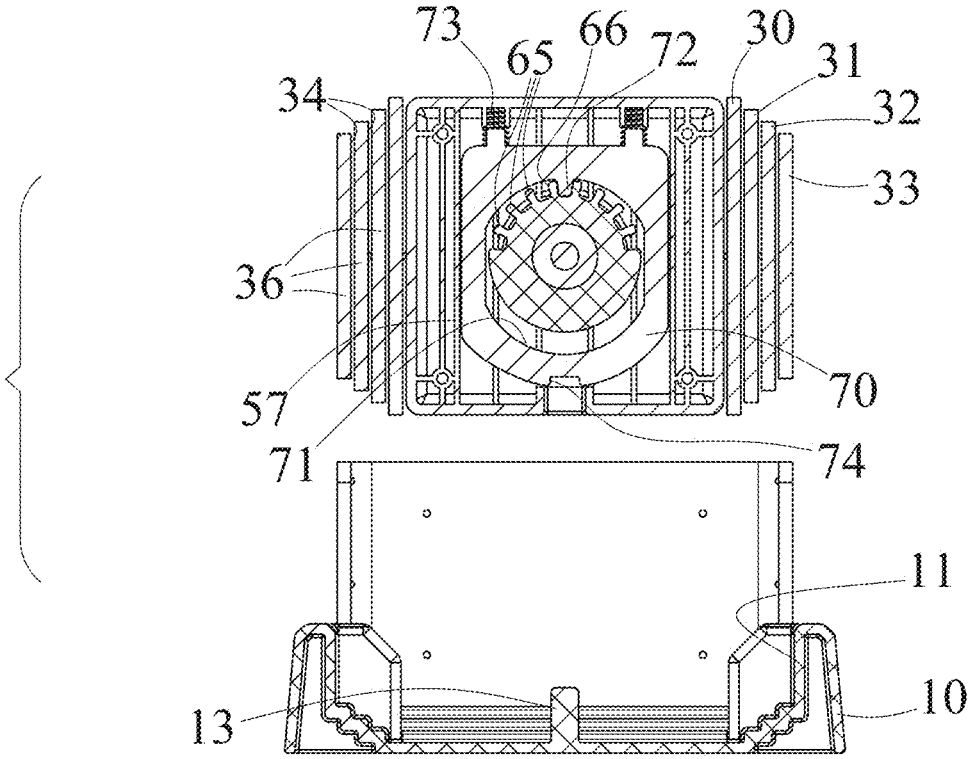
FIG. 3 is a cross sectional and partial exploded view of the adjustable dumbbell assembly, similar to FIG. 2, illustrating the operation of the adjustable dumbbell assembly.
Figure 4:
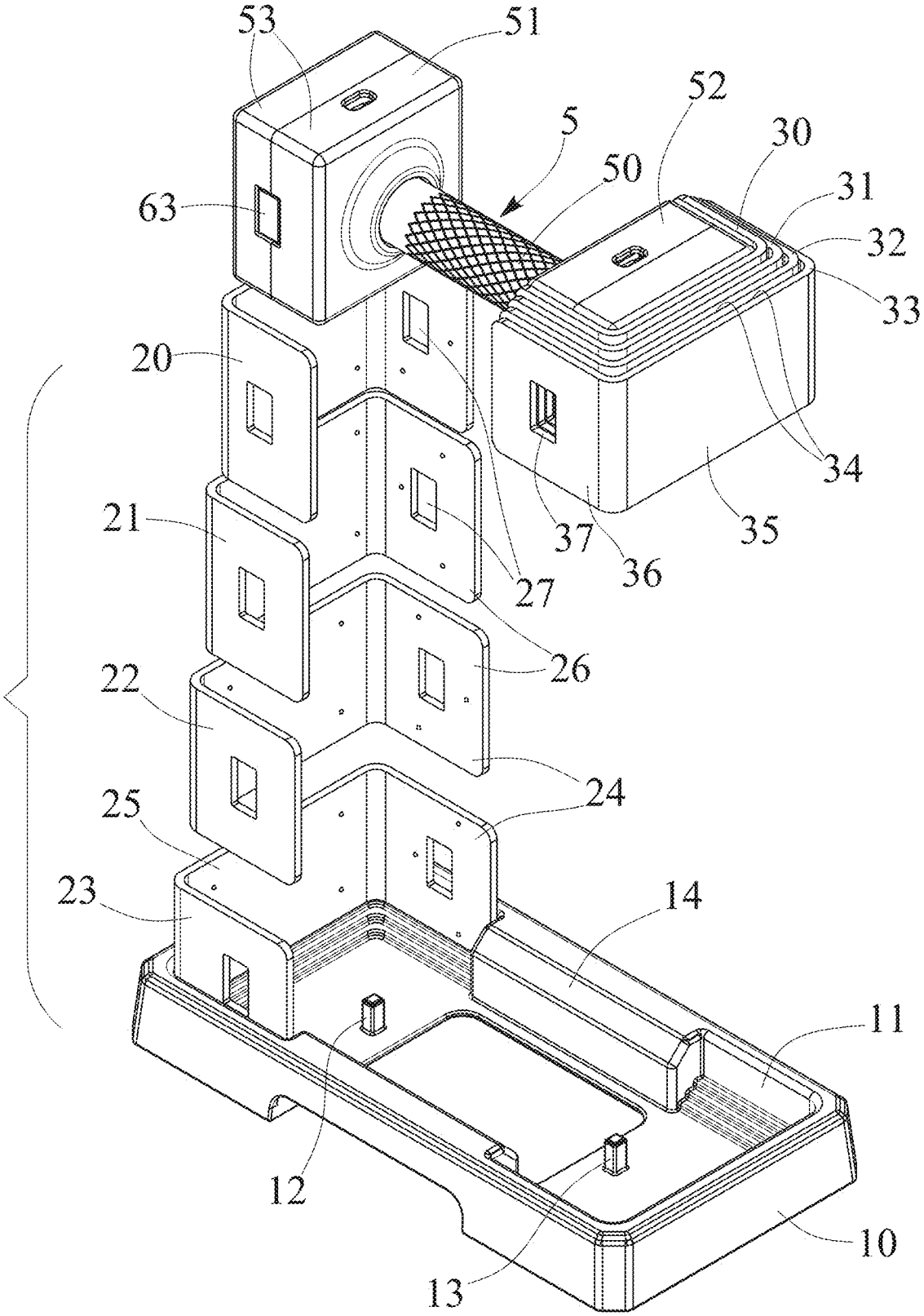
FIG. 4 is a partial exploded view of the adjustable dumbbell assembly.

One or more (such as two) racks or tongues or catches 63, 64 are slidably received or engaged in each of the housings 51, 52 and slidably engaged with the openings 27, 37 of the panels 26, 36 of the weight members 20-23 and the weight elements 30-33 and meshed or engaged with the gear 62 of the follower 60 (FIGS. 9, 10) for allowing the catches 63, 64 to be slid or moved to engage with the openings 27, 37 of the panels 26, 36 of the weight members 20-23 and the weight elements 30-33 and for anchoring or retaining or positioning the selected or predetermined or required number of the weight members 20-23 and the weight elements 30-33 to the housing 51, 52 and the handle bar 50 when the gears 62 of the follower 60 are pivoted or rotated relative to the housings 51, 52 with or by the handle bar 50. As best shown in FIGS. 2-3 and 5, the followers 60 each include one or more teeth 65 and/or depressions or notches 66 formed therein, such as formed in the upper portion thereof.

A latch or frame 70 is slidably received or engaged in each of the housings 51, 52, and includes a space or compartment 71 (FIGS. 5, 6) formed therein for selectively receiving or engaging with the follower 60, and includes a detent or tongue or key 72 extended into the compartment 71 thereof for selectively engaging with the teeth 65 and/or the notches 66 of the follower 60 and for selectively anchoring or retaining or positioning the follower 60 to the housing 51, 52, and for preventing the follower 60 and the handle bar 50 from being pivoted or rotated relative to the housing 51, 52. It is preferable that the housings 51, 52 each include a guide member or track 57 formed or provided therein (FIGS. 2-3 and 6) for slidably engaging with the frame 70 and for guiding and limiting the frame 70 to slide and move up and down relative to the housing 51, 52, and for preventing the frame 70 and the follower 60 and the handle bar 50 from being pivoted or rotated relative to the housing 51, 52.

One or more (such as two) spring biasing members 73 are provided in each of the housings 51, 52, and engaged with or between the housing 51, 52 and the frame 70 for biasing and forcing or moving the key 72 to engage with either of the teeth 65 and/or the notches 66 of the follower 60. The frames 70 each include a recess or depression 74 formed therein, such as formed in the lower or bottom portion thereof for selectively receiving or engaging with the respective stud 12, 13 of the receptacle 10 (FIGS. 2, 3) and arranged for allowing the frames 70 to be moved upwardly relative to the housing 51, 52, against the spring biasing members 73, by the stud 12, 13 of the receptacle 10, best shown in FIG. 2, when the housing 51, 52 is disposed or engaged into the compartments 11 of the receptacle 10 respectively.

Figure 7:
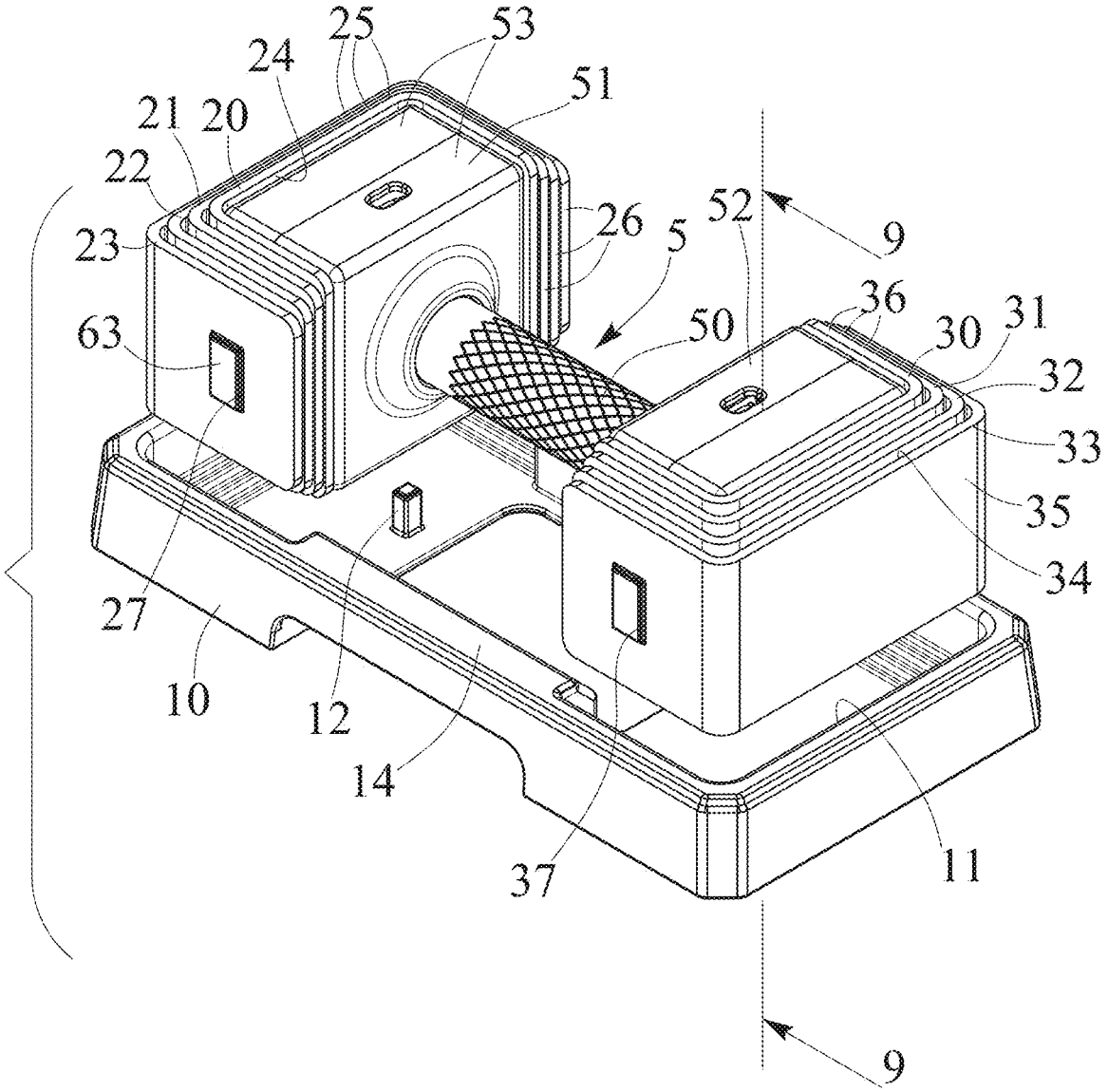
FIGS. 7, 8 are still further partial exploded views illustrating the operation of the adjustable dumbbell assembly.
Figure 8:
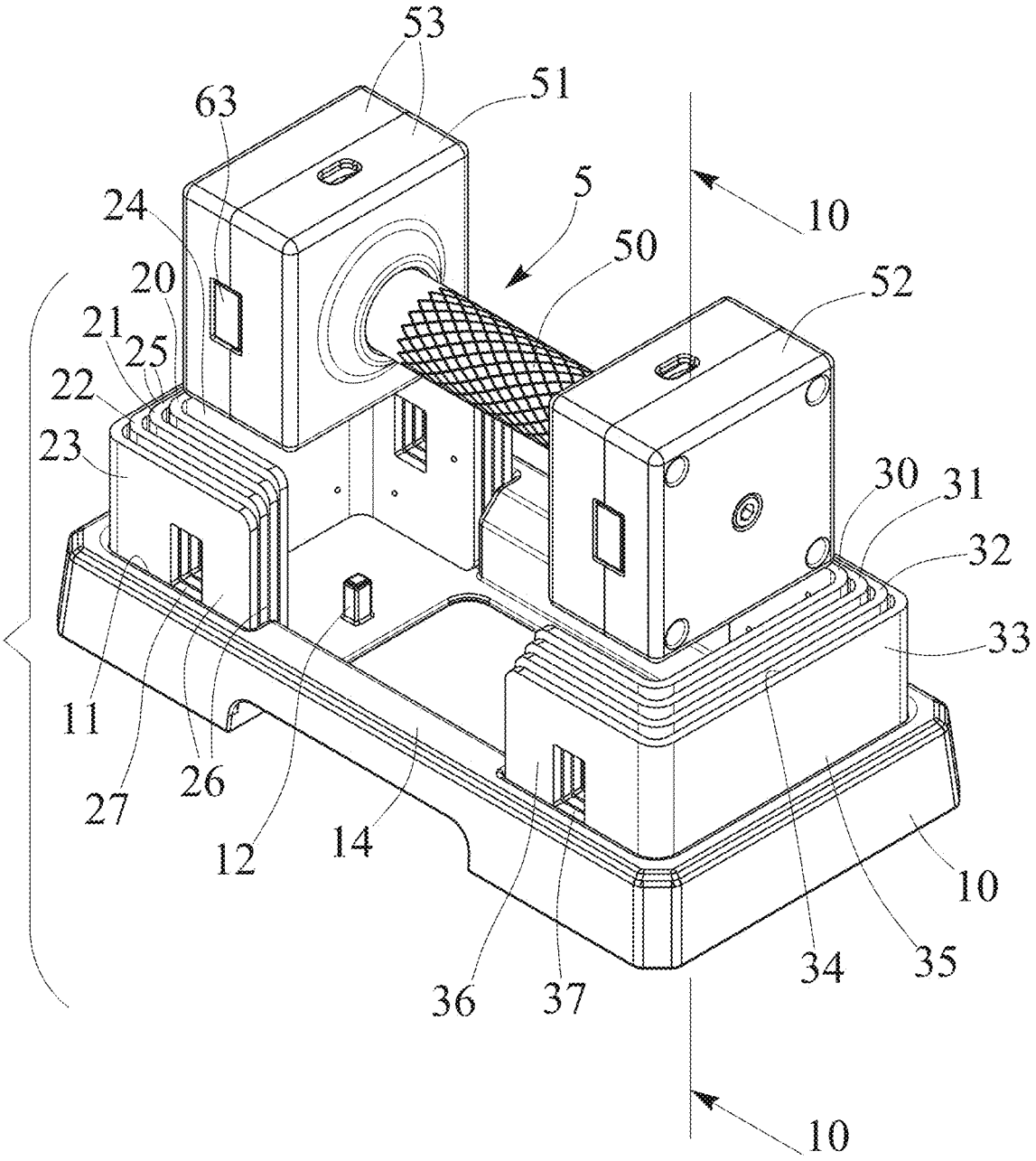

In operation, as shown in FIGS. 1 and 2, when the housings 51, 52 are disposed or engaged into the compartments 11 of the receptacle 10 respectively, the studs 12, 13 of the receptacle 10 may be engaged with the depressions 74 of the frames 70 respectively for moving the frames 70 upwardly relative to the housing 51, 52 and for allowing the follower 60 and the handle bar 50 to be pivoted or rotated relative to the housings 51, 52 in order to slide or move the catches 63, 64 to engage with the openings 27, 37 of the panels 26, 36 of the weight members 20-23 and the weight elements 30-33 (FIGS. 9, 10) and for anchoring or retaining or positioning the selected or predetermined or required number of the weight members 20-23 and the weight elements 30-33 to the housing 51, 52 and the handle bar 50 (FIGS. 7, 8). As shown in FIG. 3, when the housings 51, 52 are elevated or moved or disengaged from the receptacle 10, the spring biasing members 73 may bias and force or move the key 72 to engage with either of the teeth 65 and/or the notches 66 of the follower 60 and to anchor or retain or position the follower 60 to the housing 51, 52 and for preventing the follower 60 and the handle bar 50 from being pivoted or rotated relative to the housing 51, 52.

Accordingly, the adjustable dumbbell assembly in accordance with the present invention includes a structure that may be easily and quickly adjusted to different weights, and having no extension carriers or tracks formed or provided on the end portions or extended outwardly from the end portions of the central handle bar such that the total length of the dumbbell assembly may be selectively decreased.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable dumbbell assembly comprising:

a first weight member including two side panels to form a chamber in said first weight member, and including an opening formed in each of said panels, a first housing detachably engaged in said chamber of said first weight member, two first catches slidably received and engaged in said first housing and slidably engageable with said openings of said panels of said first weight member for anchoring said first housing to said first weight member selectively, a first follower rotatably received and engaged in said first housing, and said first follower including a first gear engaged with said first catches for moving said first catches to engage with said openings of said panels of said first weight member and to anchor said first housing to said first weight member selectively, a first weight element including two side panels to form a chamber in said first weight element, and including an opening formed in each of said panels of said first weight element, a second housing detachably engaged in said chamber of said first weight element, two second catches slidably received and engaged in said second housing and slidably engageable with said openings of said panels of said first weight element for anchoring said second housing to said first weight element selectively, a second follower rotatably received and engaged in said second housing, and said second follower including a second gear engaged with said second catches for moving said second catches to engage with said openings of said panels of said first weight element and to anchor said second housing to said first weight element selectively, and a handle bar engaged into said first and said second housings, and said handle bar being secured to said first and said second followers for rotating said first and said second followers relative to said first and said second housings and for actuating said first and said second catches to engage with said openings of said panels of said first weight member and said first weight element and for anchoring said first and said second housings to said first weight member and said first weight element respectively.

2. The adjustable dumbbell assembly as claimed in claim 1, wherein said first and said second housings each include a frame for selectively engaging with said first and said second followers and for anchoring said first and said second followers to said first and said second housings respectively.

3. The adjustable dumbbell assembly as claimed in claim 2, wherein said frames each include a key for selectively engaging with said first and said second followers respectively.

4. The adjustable dumbbell assembly as claimed in claim 3, wherein said first and said second followers each include at least one tooth for selectively engaging with said key of said frame respectively.

5. The adjustable dumbbell assembly as claimed in claim 3, wherein said first and said second housings each include a spring biasing member engaged with said frame for biasing and forcing said key to engage with said first and said second followers respectively.

6. The adjustable dumbbell assembly as claimed in claim 3 further comprising a receptacle including two compartments formed in said receptacle, and two studs extended into said compartments of said receptacle respectively and engageable with said frames for forcing said keys of said frames to be disengaged from said first and said second followers.

7. The adjustable dumbbell assembly as claimed in claim 1, wherein said first and said second housings each include a projection for engaging with said first and said second followers and for anchoring said first and said second followers to said first and said second housings respectively.

8. The adjustable dumbbell assembly as claimed in claim 7, wherein said first and said second followers each include at least one recess for engaging with said projections, respectively.

9. The adjustable dumbbell assembly as claimed in claim 1 further comprising at least one second weight member including a chamber formed in said at least one second weight member for receiving said first weight member.

10. The adjustable dumbbell assembly as claimed in claim 9, wherein said at least one second weight member includes two side panels, and an opening formed in each of said panels of said at least one second weight member for selectively engaging with said first catches.

11. The adjustable dumbbell assembly as claimed in claim 1 further comprising at least one second weight element including a chamber formed in said at least one second weight element for receiving said first weight element.

12. The adjustable dumbbell assembly as claimed in claim 11, wherein said at least one second weight element includes two side panels, and an opening formed in each of said panels of said at least one second weight element for selectively engaging with said second catches.

* * * * *